US007441669B1

(12) United States Patent
Dalbey

(10) Patent No.: US 7,441,669 B1
(45) Date of Patent: Oct. 28, 2008

(54) HOCKEY STICK RACK SYSTEM

(76) Inventor: Doyle J. Dalbey, 1307 Libra La., Fargo, ND (US) 58104

( * ) Notice: Subject to any disclaimer, the term of this patent is extended or adjusted under 35 U.S.C. 154(b) by 193 days.

(21) Appl. No.: 11/353,287

(22) Filed: Feb. 9, 2006

(51) Int. Cl.
*A47F 7/00* (2006.01)

(52) U.S. Cl. ..... 211/85.7; 211/60.1

(58) Field of Classification Search ..... 211/60.1, 211/64, 66, 70.2, 70.5, 70.6, 87.01, 89.01, 211/182; 248/113, 316.1, 316.2, 316.3, 316.7, 248/511; 312/111; 403/292; 52/589.1, 590.1, 52/590.2

See application file for complete search history.

(56) References Cited

U.S. PATENT DOCUMENTS

| | | | | |
|---|---|---|---|---|
| 1,366,324 | A * | 1/1921 | Newquist | 248/113 |
| 1,678,353 | A | 7/1928 | Reach | |
| 2,753,189 | A | 7/1956 | Conroy | 280/40 |
| 3,880,336 | A | 4/1975 | Demasson | 224/45 |
| 4,126,327 | A | 11/1978 | Taber | 280/47.26 |
| 4,181,221 | A | 1/1980 | Tennant | 206/317 |
| 4,410,095 | A * | 10/1983 | Dembicks | 211/70.6 |
| 4,905,951 | A | 3/1990 | Putness | 248/316.1 |
| 5,005,710 | A * | 4/1991 | Hofer | 211/70.6 |
| 5,464,181 | A | 11/1995 | Leventhal | 248/113 |
| 5,848,716 | A | 12/1998 | Waranius | 211/189 |
| 5,855,285 | A * | 1/1999 | Laird et al. | 211/70.6 |
| 6,220,557 | B1 | 4/2001 | Ziaylek et al. | 248/316.1 |
| 6,264,147 | B1 | 7/2001 | Mitchell | 248/111 |
| 6,752,278 | B2 | 7/2001 | Craft et al. | 248/111 |
| 6,330,950 | B1 | 12/2001 | Loika | 211/85.7 |
| 6,431,627 | B1 | 8/2002 | Tomeny | 294/163 |
| 6,547,085 | B2 | 4/2003 | Belisle | 211/85.7 |
| 6,591,994 | B1 | 7/2003 | Bearss | 211/85.7 |
| 6,595,376 | B1 * | 7/2003 | Lin | 211/70.6 |
| 6,626,402 | B1 | 9/2003 | Kaminstein | 248/110 |
| 6,691,877 | B1 | 2/2004 | Ohm | 211/85.7 |
| 6,749,074 | B1 | 6/2004 | Hileman et al. | 211/85.7 |
| 6,880,711 | B2 | 4/2005 | Collier | 211/85.7 |
| 7,213,713 | B2 * | 5/2007 | Matsui | 211/85.7 |
| 2002/0113030 | A1 | 8/2002 | Belisle | 211/85.7 |
| 2006/0011566 | A1 * | 1/2006 | Guy | 211/60.1 |
| 2006/0032828 | A1 * | 2/2006 | Chiu | 211/66 |

FOREIGN PATENT DOCUMENTS

| | | | |
|---|---|---|---|
| CA | 2262302 | * | 2/1998 |

* cited by examiner

*Primary Examiner*—Katherine W Mitchell
*Assistant Examiner*—Jeremy C Ramsey

(57) ABSTRACT

A hockey stick rack system for efficiently retaining a plurality of hockey sticks in an upright and organized manner. The hockey stick rack system includes a plurality of racks each comprised of a plurality of cutouts with rubber pads and foam pads in opposition to one another. Each of the racks include at their opposing ends a vertical member and a horizontal member that are connected to a first connector and a second connector.

18 Claims, 8 Drawing Sheets

HOCKEY STICK RACK SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to hockey stick racks and more specifically it relates to a hockey stick rack system for efficiently retaining a plurality of hockey sticks in an upright and organized manner.

2. Description of the Related Art

Any discussion of the prior art throughout the specification should in no way be considered as an admission that such prior art is widely known or forms part of common general knowledge in the field.

Hockey racks and other hockey stick storage devices have been in use for years. Conventional hockey racks are comprised of non-adjustable structures that receive a defined number of hockey sticks.

While these devices may be suitable for the particular purpose to which they address, they are not as suitable for efficiently retaining a plurality of hockey sticks in an upright and organized manner. Conventional hockey stick racks do not provide the flexibility to increase the number of hockey sticks that may be supported.

In these respects, the hockey stick rack system according to the present invention substantially departs from the conventional concepts and designs of the prior art, and in so doing provides an apparatus primarily developed for the purpose of efficiently retaining a plurality of hockey sticks in an upright and organized manner.

BRIEF SUMMARY OF THE INVENTION

In view of the foregoing disadvantages inherent in the known types of hockey stick racks now present in the prior art, the present invention provides a new hockey stick rack system construction wherein the same can be utilized for efficiently retaining a plurality of hockey sticks in an upright and organized manner.

The general purpose of the present invention, which will be described subsequently in greater detail, is to provide a new hockey stick rack system that has many of the advantages of the hockey stick racks mentioned heretofore and many novel features that result in a new hockey stick rack system which is not anticipated, rendered obvious, suggested, or even implied by any of the prior art hockey stick racks, either alone or in any combination thereof.

To attain this, the present invention generally comprises a plurality of racks each comprised of a plurality of cutouts with rubber pads and foam pads in opposition to one another. Each of the racks include at their opposing ends a vertical member and a horizontal member that are connected to a first connector and a second connector.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a hockey stick rack system that will overcome the shortcomings of the prior art devices.

A second object is to provide a hockey stick rack system for efficiently retaining a plurality of hockey sticks in an upright and organized manner.

Another object is to provide a hockey stick rack system that reduces clutter in a room where hockey equipment is stored.

An additional object is to provide a hockey stick rack system that can be mounted to various structures.

A further object is to provide a hockey stick rack system that easily receives and dispenses hockey sticks.

Another object is to provide a hockey stick rack system that may be adjusted to receive left-handed and right-handed hockey sticks.

A further object is to provide a hockey stick rack system that may be adjusted in length.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
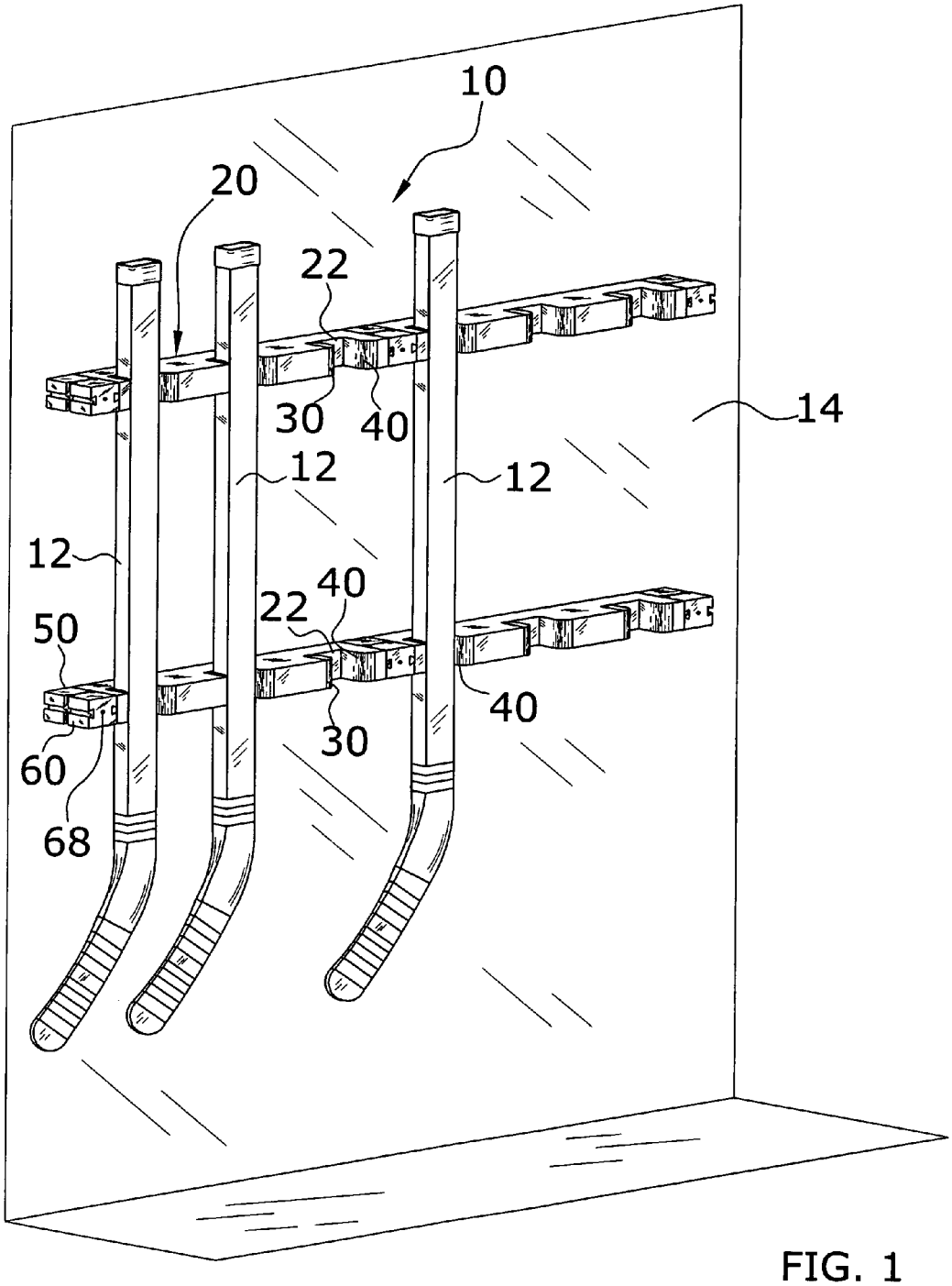
FIG. 1 is an upper perspective view of the present invention attached to a wall and supporting a plurality of hockey sticks.

Turning now descriptively to the drawings, in which similar reference characters denote similar elements throughout the several views, FIGS. 1 through 10 illustrate a hockey stick rack system 10, which comprises a plurality of racks 20 each comprised of a plurality of cutouts 22 with rubber pads 40 and foam pads 30 in opposition to one another. Each of the racks 20 include at their opposing ends a vertical member 70 and a horizontal member 72 that are connected to a first connector 50 and a second connector 60.

B. Racks

FIGS. 1 through 4 illustrate the racks 20 that are used to receive and support hockey sticks 12. The racks 20 are comprised of at least one upper rack 20 and at least one lower rack 20 positioned substantially parallel to one another in a distally spaced apart manner as shown in FIG. 1 of the drawings. The upper rack 20 supports an upper portion of the hockey stick and the lower rack 20 supports a lower portion of the hockey stick. The racks 20 may each have various lengths and may retain any number of hockey sticks 12. The racks 20 are preferably connectable to one another in an end-to-end manner to allow for adjustment of the overall length of the present invention to receive additional hockey sticks 12. Further discussion will focus upon a single rack 20 for simplicity only even though it is known by the drawings and above discussion that a plurality of racks 20 are used for the present invention.

Figure 2:
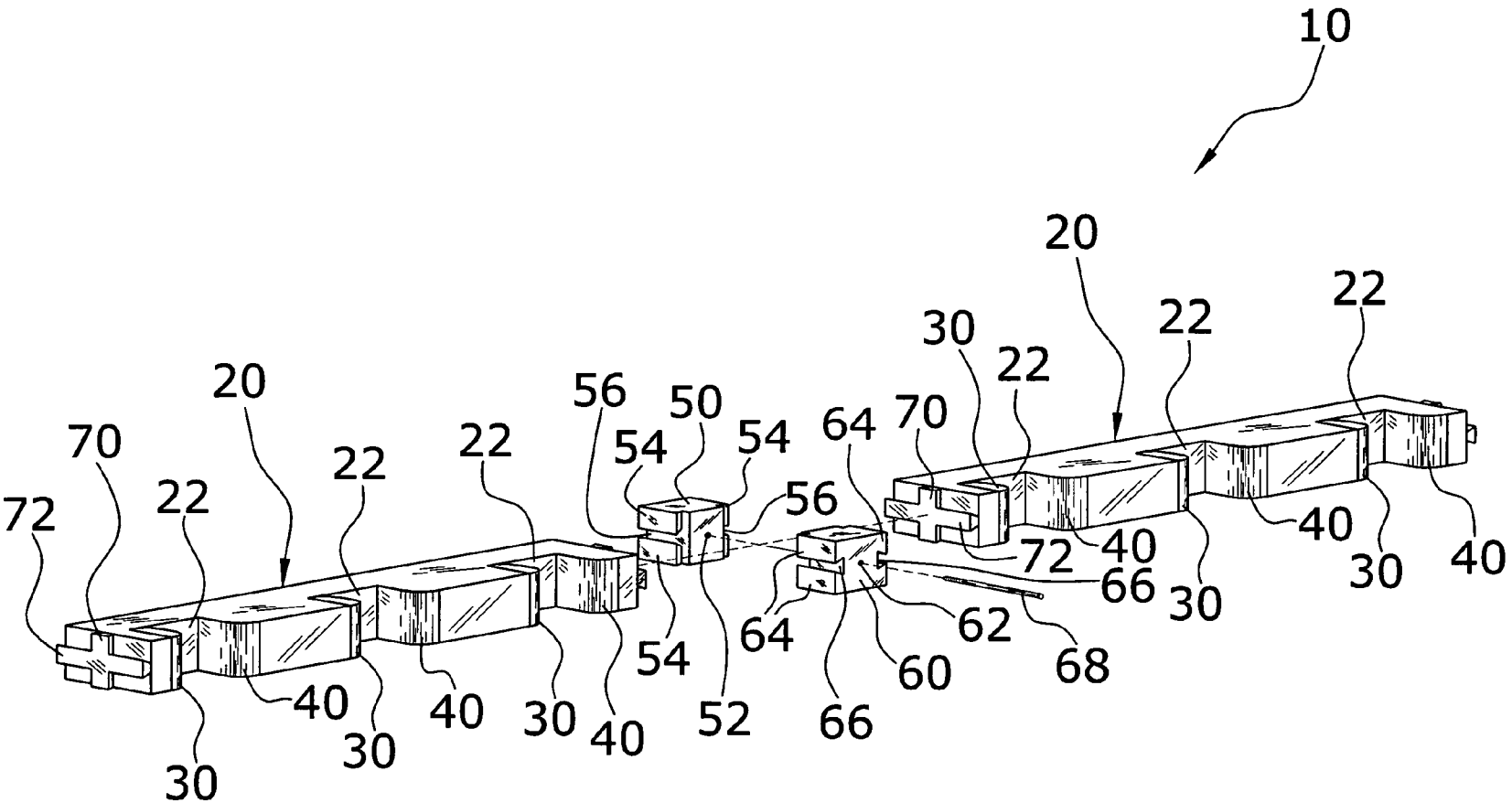
FIG. 2 is an exploded upper perspective view of two racks and connectors.
Figure 3:
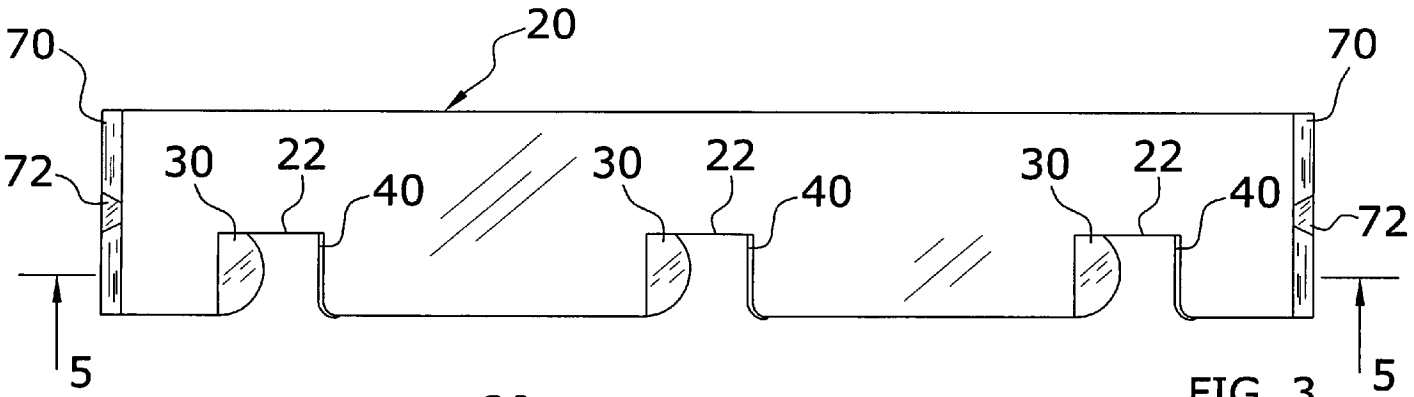
FIG. 3 is a top view of the rack.
Figure 4:
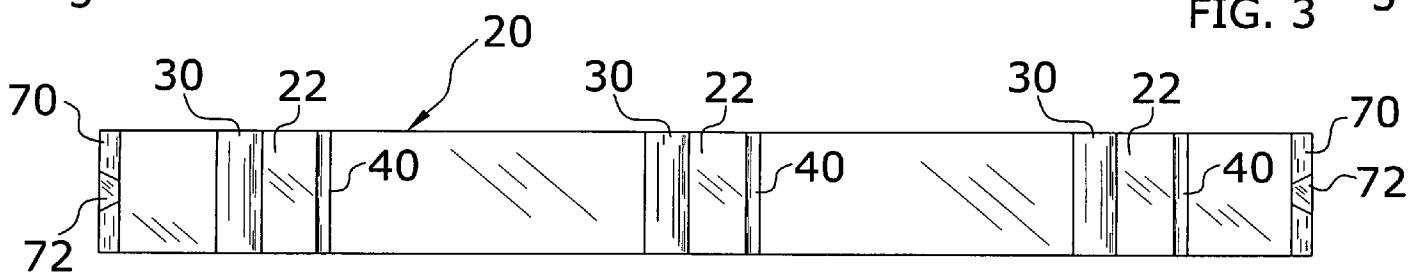
FIG. 4 is a front view of the rack.
Figure 5:
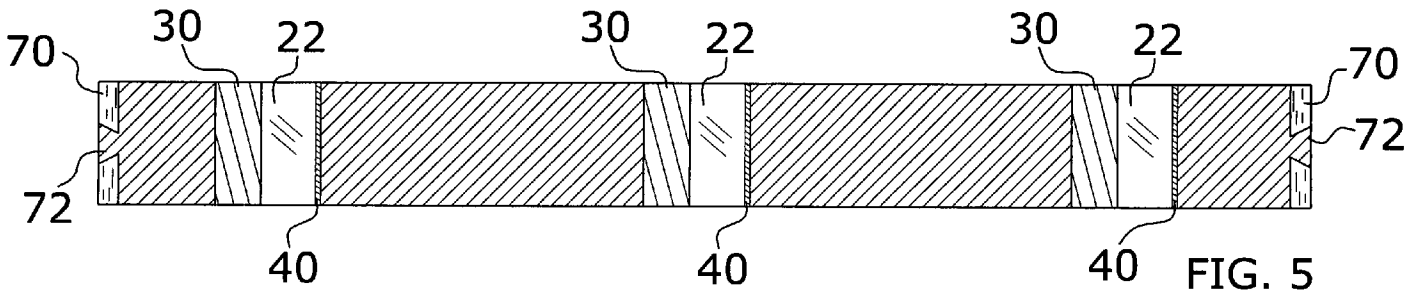
FIG. 5 is a cross sectional view taken along line 5-5 of FIG. 3.

The rack 20 includes a plurality of cutouts 22 to receive hockey sticks 12 such as three as shown in FIGS. 1 through 5 and 10 of the drawings. A plurality of rubber pads 40 are attached to a first side of each of the plurality of cutouts 22 as best illustrated in FIGS. 2 and 3 of the drawings. The rubber pads 40 preferably extend from the first side and extend about a rounded corner of the cutout to a front side of the rack 20 as best shown in FIGS. 3 and 4 of the drawings.

A plurality of foam pads 30 are attached to a second side of each of the plurality of cutouts 22 in opposition to the plurality of rubber pads 40 as best illustrated in FIGS. 2 and 3 of the drawings. The plurality of foam pads 30 are preferably thicker than the plurality of rubber pads 40 as shown in FIG. 3 of the drawings. The plurality of foam pads 30 are preferably comprised of a rounded portion to allow for allowing a hockey stick to be inserted into the cutouts 22 within the rack 20. A rear portion of the hockey stick is first frictionally engaged with the rubber pad and then the hockey stick is rotated inwardly so that the front portion of the handle of the hockey stick frictionally engages the foam pad which compresses to receive the handle.

C. Connectors

Figure 10:
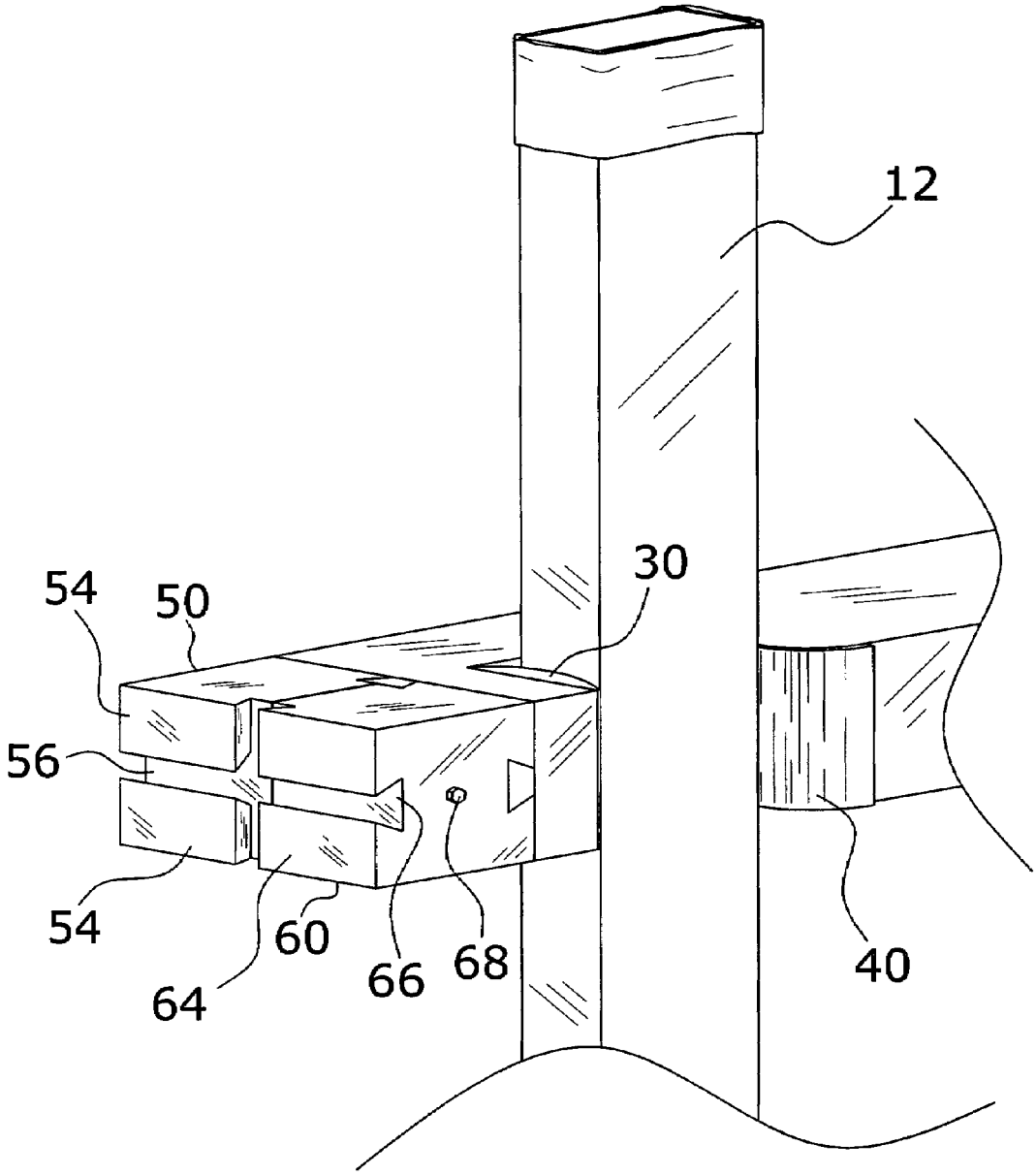
FIG. 10 is a magnified upper perspective view of a hockey stick positioned within a rack.

As discussed above and shown in FIGS. 1 and 2 of the drawings, it is preferable that the racks 20 be connectable to one another in an end-to-end manner to expand the capacity to receive hockey sticks 12. It is preferable that each rack 20 includes at their opposing ends a vertical member 70 and a horizontal member 72 as best illustrated in FIGS. 2 and 10 of the drawings.

Figure 7:
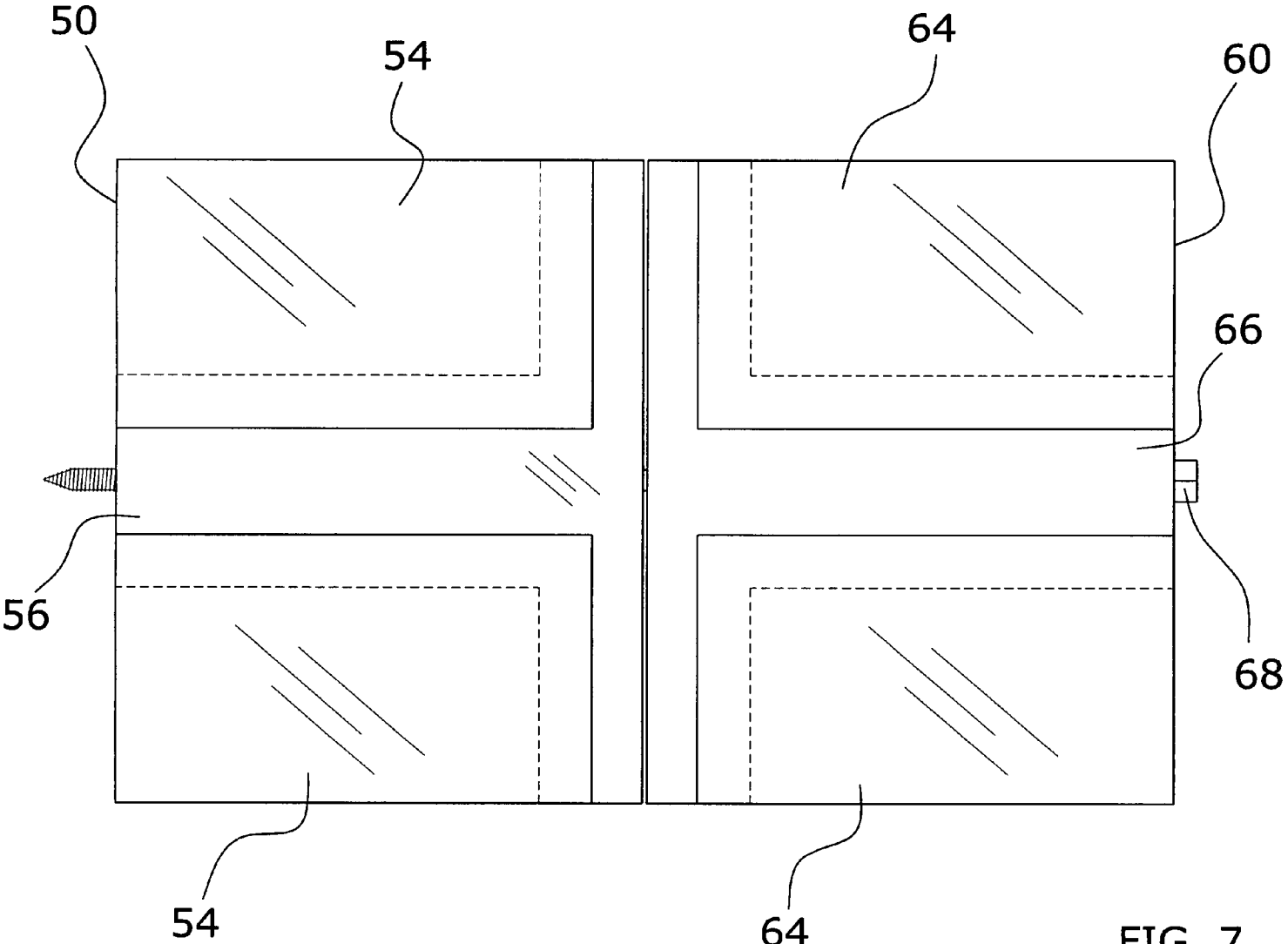
FIG. 7 is a side view of the first connector connected to the second connector.
Figure 8:
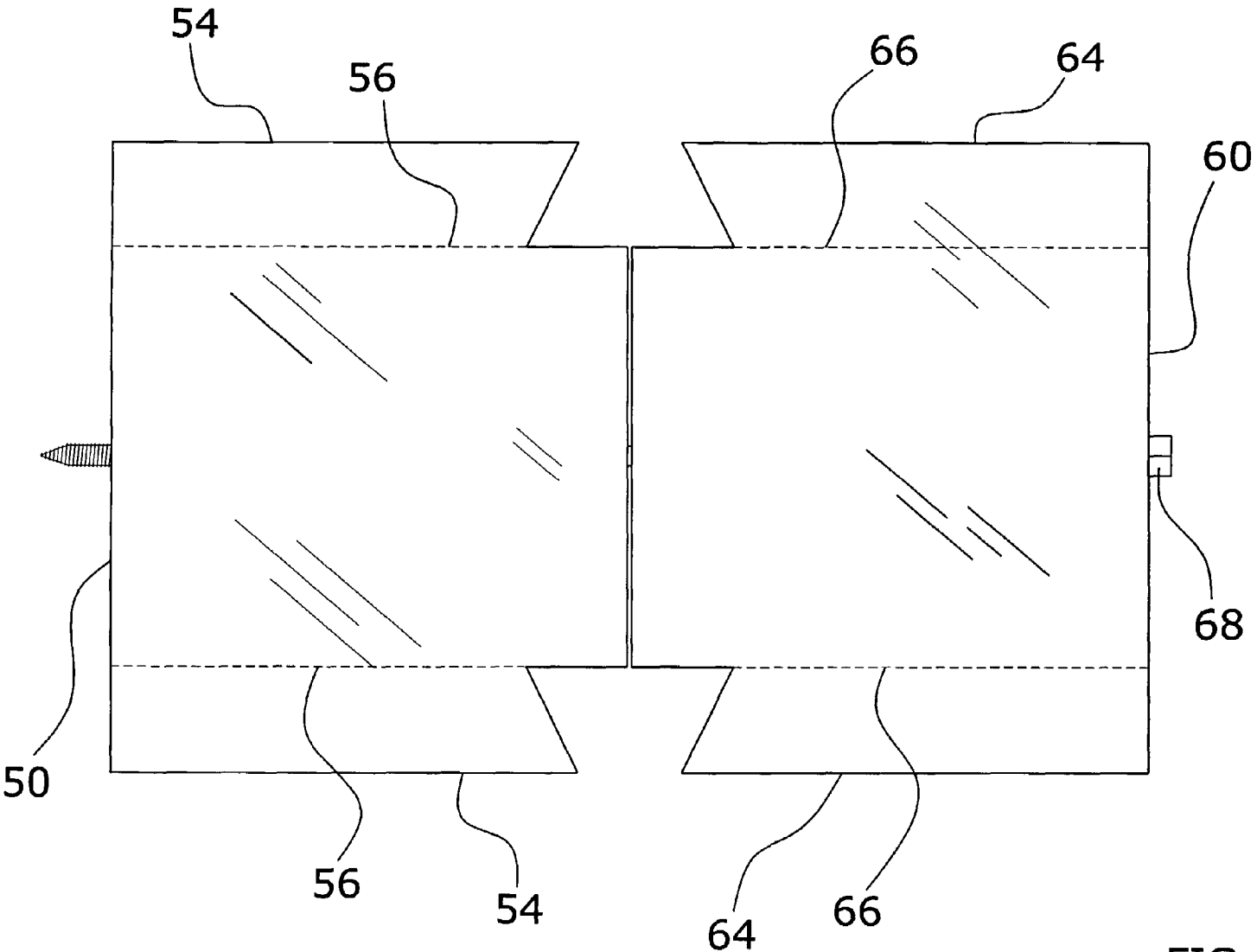
FIG. 8 is a top view of the first connector connected to the second connector.
Figure 9:
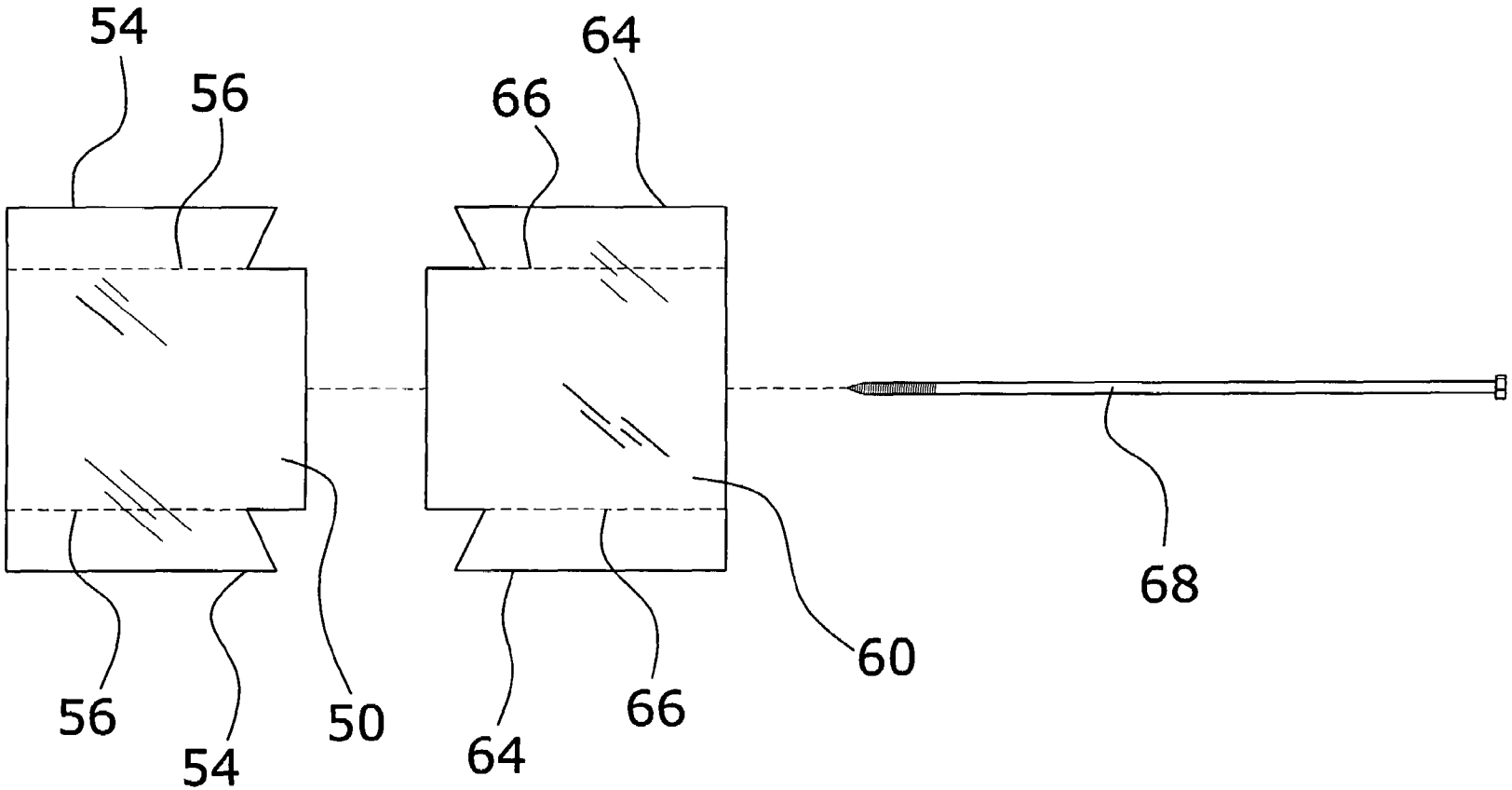
FIG. 9 is an exploded top view of the first connector connected to the second connector.

A first connector 50 and a second connector 60 are attachable to opposing ends of the plurality of racks 20 for securing the plurality of racks 20 together in an end-to-end manner. The first connector 50 and the second connector 60 are further utilized to secure the rack 20 to a wall 14 or other structure. The first connector 50 includes a first aperture 52 and the second connector 60 includes a second aperture 62 aligned with the first aperture 52 to receive a fastener 68 68 (e.g. threaded screw). The fastener 68 68 is extendable completely through the connectors 50, 60 as illustrated in FIG. 7 of the drawings.

Figure 6:
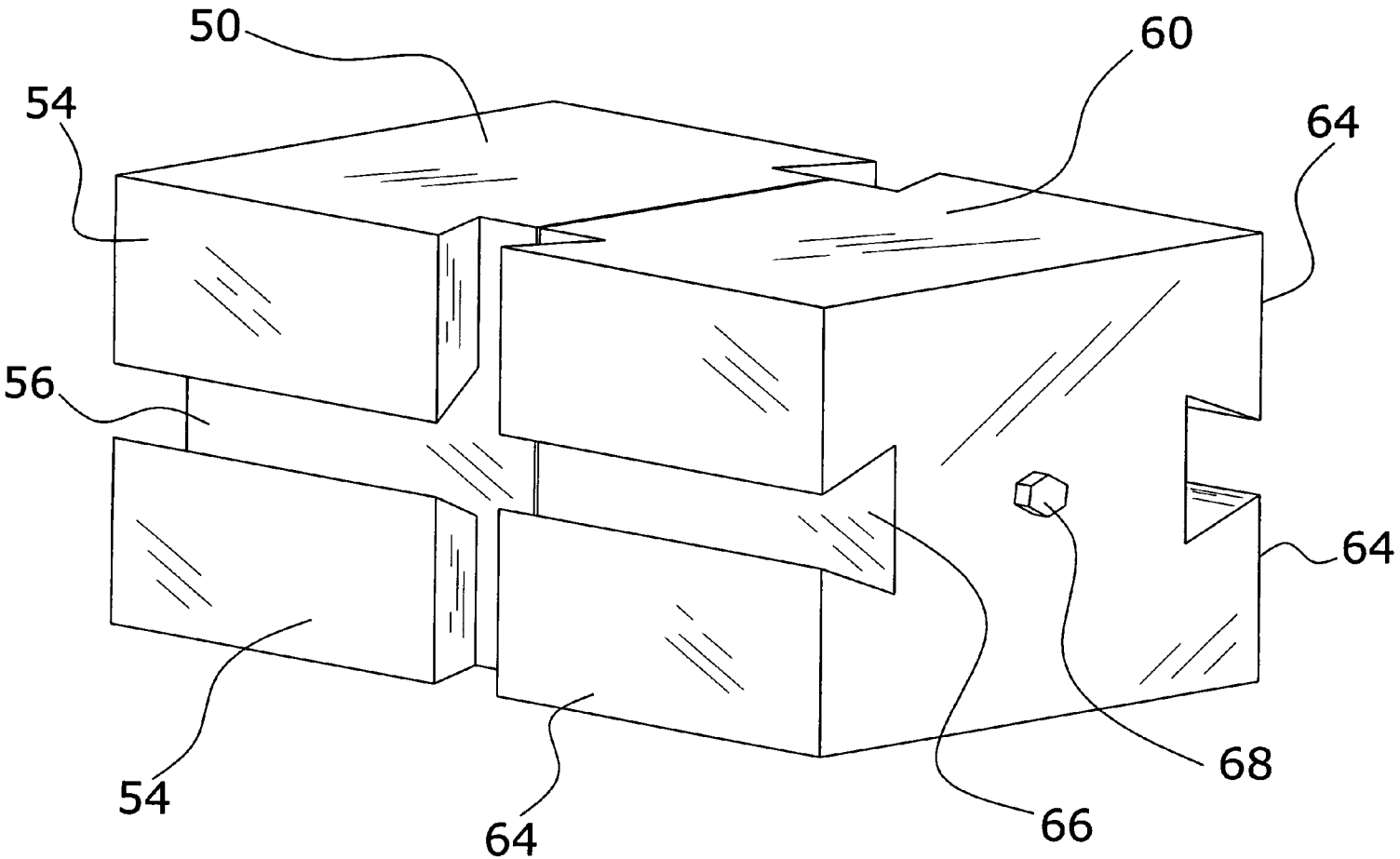
FIG. 6 is an upper perspective view of the first connector connected to the second connector.

The first connector 50 includes a pair of first guides 54 extending from a first portion and a second portion of the first connector 50 forming a pair of first slots 56 as shown in FIGS. 2 and 6 of the drawings. The second connector 60 also includes a pair of second guides 64 extending from a second portion and a second portion of the second connector 60 forming a pair of second slots 66 as shown in FIGS. 2 and 6 of the drawings.

The first slots 56 and the second slots 66 each preferably have a tapered cross section as best illustrated in FIGS. 2 and 6 of the drawings. The horizontal member 72 is preferably comprised of a tapered cross section corresponding to the first slots 56 and the second slots 66. The inner ends of the first guides 54 and the second guides 64 are comprised of a tapered structure forming vertical tapered slots when positioned near one another. The vertical member 70 is preferably comprised of a tapered cross section corresponding to the vertical tapered slots as best shown in FIG. 4 of the drawings.

D. Operation

In use, the user first slides the first connector 50 onto the horizontal member 72 until the inner end of the first guides 54 engage the corresponding vertical member 70 on a first end of the rack 20. The user repeats this with another first connector 50 on an opposite second end of the rack 20.

The user then slides the second connector 60 onto the horizontal member 72 until the inner end of the second guides 64 engage the corresponding vertical member 70 on the first end of the rack 20. The user repeats this with another second connector 60 on the opposite second end of the rack 20. The user then positions the rack 20 on a wall 14 or other structure to be attached to and extends a fastener 68 68 through the apertures 52, 62 into the wall 14. The rack 20 is then attached to the wall 14 as shown in FIG. 1 of the drawings. If the user is to position left-handed hockey sticks 12 onto the rack 20 then the rack 20 can be rotated one-hundred-eighty degrees prior to attaching to the wall 14.

The above process is used to secure a lower rack 20 below the upper rack 20 as shown in FIG. 1 of the drawings. If additional hockey sticks 12 are to be stored, an additional set of racks 20 can be attached to an end of the installed racks 20 by removing one set of connectors 50, 60 to attach the racks 20 to as discussed above.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A hockey stick rack system, comprising:

a plurality of racks, wherein each of said plurality of racks includes a plurality of cutouts to receive hockey sticks, a plurality of rubber pads attached to a first side of said plurality of cutouts, and a plurality of foam pads attached to a second side of said plurality of cutouts in opposition to said plurality of rubber pads;

wherein each of said plurality of racks include at their opposing ends a vertical member and a horizontal member that are connected to a first connector and a second connector;

wherein said first connector is comprised of a pair of first guides extending from a first portion and a second portion of said first connector forming a pair of first slots, and wherein said second connector is comprised of a pair of second guides extending from a first portion and a second portion of said second connector forming a pair of second slots.

2. The hockey stick rack system of claim 1, wherein said plurality of racks are comprised of at least one upper rack and at least one lower rack.

3. The hockey stick rack system of claim 1, wherein said plurality of foam pads are thicker than said plurality of rubber pads.

4. The hockey stick rack system of claim 1, wherein said plurality of foam pads are comprised of a rounded portion.

5. The hockey stick rack system of claim 1, wherein said plurality of racks are connectable to one another in an end-to-end manner.

6. The hockey stick rack system of claim 1, including a means for connecting at least two of said plurality of racks together in an end-to-end manner.

7. The hockey stick rack system of claim 1, including a first connector and a second connector attachable to opposing ends of said plurality of racks for securing said plurality of racks together in an end-to-end manner.

8. The hockey stick rack system of claim 1, wherein said first connector includes a first aperture and wherein said second connector includes a second aperture aligned with said first aperture to receive a fastener.

9. The hockey stick rack system of claim 1, wherein said first slots and said second slots have a tapered cross section, and wherein said horizontal member is comprised of a tapered cross section corresponding to said first slots and said second slots.

10. The hockey stick rack system of claim 9, wherein ends of said first guides and said second guides are comprised of a tapered structure forming vertical tapered slots, and wherein said vertical member is comprised of a tapered cross section corresponding to said vertical tapered slots.

11. A hockey stick rack system, comprising:

a plurality of racks, wherein said plurality of racks are comprised of at least one upper rack and at least one lower rack;

wherein each of said plurality of racks includes a plurality of cutouts to receive hockey sticks, a plurality of rubber pads attached to a first side of said plurality of cutouts, and a plurality of foam pads attached to a second side of said plurality of cutouts in opposition to said plurality of rubber pads;

wherein each of said plurality of racks include at their opposing ends a vertical member and a horizontal member that are connected to a first connector and a second connector; and a first connector and a second connector attachable to opposing ends of said plurality of racks for securing said plurality of racks together in an end-to-end manner, wherein said first connector includes a first aperture and wherein said second connector includes a second aperture aligned with said first aperture to receive a fastener;

wherein said first connector is comprised of a pair of first guides extending from a first portion and a second portion of said first connector forming a pair of first slots, and wherein said second connector is comprised of a pair of second guides extending from a second portion and a second portion of said second connector forming a pair of second slots;

wherein said first slots and said second slots have a tapered cross section, and wherein said horizontal member is comprised of a tapered cross section corresponding to said first slots and said second slots;

wherein ends of said first guides and said second guides are comprised of a tapered structure forming vertical tapered slots, and wherein said vertical member is comprised of a tapered cross section corresponding to said vertical tapered slots.

12. The hockey stick rack system of claim 11, wherein said plurality of foam pads are thicker than said plurality of rubber pads.

13. The hockey stick rack system of claim 11, wherein said plurality of foam pads are comprised of a rounded portion.

14. The hockey stick rack system of claim 11, wherein said plurality of foam pads are connectable to one another in an end-to-end manner.

15. A hockey stick rack system, comprising:

a plurality of racks, wherein each of said plurality of racks includes a plurality of cutouts to receive hockey sticks, a plurality of rubber pads attached to a first side of said plurality of cutouts, and a plurality of foam pads attached to a second side of said plurality of cutouts in opposition to said plurality of rubber pads;

wherein each of said plurality of racks include at their opposing ends a vertical member and a horizontal member that are connected to a first connector and a second connector;

wherein said first connector is comprised of a pair of first guides extending from a first portion and a second portion of said first connector forming a pair of first slots, and wherein said second connector is comprised of a pair of second guides extending from a second portion and a second portion of said second connector forming a pair of second slots.

16. The hockey stick rack system of claim 15, wherein said plurality of racks are comprised of at least one upper rack and at least one lower rack.

17. The hockey stick rack system of claim 15, including a means for connecting at least two of said plurality of racks together in an end-to-end manner.

18. The hockey stick rack system of claim 15, including a first connector and a second connector attachable to opposing ends of said plurality of racks for securing said plurality of racks together in an end-to-end manner.

* * * * *